US008092650B2

(12) United States Patent
Münch et al.

(10) Patent No.: US 8,092,650 B2
(45) Date of Patent: Jan. 10, 2012

(54) METHOD FOR PRODUCING OR TREATING A FIBROUS WEB

(75) Inventors: Rudolf Münch, Königsbronn (DE); Jörg Spindler, Gmünd (DE); Ulrich Mailänder, Heidenheim (DE); Karl Martin Olf, Donauwörth (DE)

(73) Assignee: Voith Patent GmbH, Heidenheim (DE)

( * ) Notice: Subject to any disclaimer, the term of this patent is extended or adjusted under 35 U.S.C. 154(b) by 859 days.

(21) Appl. No.: 11/627,630

(22) Filed: Jan. 26, 2007

(65) Prior Publication Data

US 2007/0169906 A1 Jul. 26, 2007

(30) Foreign Application Priority Data

Jan. 26, 2006 (DE) ..... 10 2006 003 637

(51) Int. Cl.
*D21G 9/00* (2006.01)
*D21G 7/00* (2006.01)

(52) U.S. Cl. ..... 162/198; 700/127

(58) Field of Classification Search ..... 162/198–199, 162/135–137, 263, 265, 272; 700/127–129; 427/8, 382, 395, 444; 73/159
See application file for complete search history.

(56) References Cited

U.S. PATENT DOCUMENTS 3,586,601 A * 6/1971 Persik, Jr. et al. ..... 162/252
3,847,730 A * 11/1974 Doering ..... 162/198
4,855,658 A * 8/1989 Moon ..... 318/632
4,910,688 A * 3/1990 Amini ..... 702/33
5,262,955 A * 11/1993 Lewis ..... 700/129
5,377,428 A * 1/1995 Clark ..... 34/446
5,539,634 A * 7/1996 He ..... 700/38
5,554,262 A * 9/1996 Turner ..... 162/198
5,649,448 A * 7/1997 Koskimies et al. ..... 73/159
6,207,017 B1 * 3/2001 Munch et al. ..... 162/198
6,319,362 B1 * 11/2001 Huhtelin et al. ..... 162/198
6,328,851 B1 * 12/2001 Huhtelin et al. ..... 162/198
6,365,004 B1 * 4/2002 Hamstrom et al. ..... 162/198
6,446,356 B1 * 9/2002 Hamstrom et al. ..... 34/451
6,564,117 B1 * 5/2003 Chen et al. ..... 700/129
6,577,916 B1 * 6/2003 Gehr et al. ..... 700/129
6,584,703 B1 * 7/2003 Maenpaa et al. ..... 34/446
6,640,152 B1 * 10/2003 Chen et al. ..... 700/128
6,799,083 B2 * 9/2004 Chen et al. ..... 700/128
6,807,510 B1 * 10/2004 Backstrom et al. ..... 702/150
6,849,851 B2 * 2/2005 Komulainen et al. ..... 250/340
6,863,919 B1 * 3/2005 Maenpaa et al. ..... 427/8
7,147,164 B1 * 12/2006 Burma ..... 235/472.02
7,407,562 B2 * 8/2008 Heikkinen et al. ..... 162/198
7,513,975 B2 * 4/2009 Burma ..... 162/263

(Continued)

FOREIGN PATENT DOCUMENTS

CA 2380801 A1 * 11/2002

(Continued)

*Primary Examiner* — Jose A Fortuna
(74) *Attorney, Agent, or Firm* — Taylor IP, P.C.

(57) ABSTRACT

This invention relates to a method for producing or treating a fibrous web, in particular a paper web or paperboard web, with which at least one property of the fibrous web, in particular a CD (cross direction) profile, such as the moisture CD profile, is established such that a preselected quality range is adhered to or a predefined quality value is undershot by no more than a predefined deviation, wherein the power consumption of the method, in particular the heat energy input, is reduced therewith by establishing at least one property such that the lowest permissible value of the quality range or the maximum permissible deviation is reached at least approximately on a straight line.

13 Claims, 1 Drawing Sheet

U.S. PATENT DOCUMENTS

| | | | | |
|---|---|---|---|---|
| 2002/0060017 | A1* | 5/2002 | Kuusisto et al. | 162/198 |
| 2002/0166970 | A1* | 11/2002 | Komulainen et al. | 250/340 |
| 2003/0216828 | A1* | 11/2003 | Puurtinen | 700/128 |
| 2004/0167657 | A1* | 8/2004 | Sasaki | 700/127 |
| 2004/0243270 | A1* | 12/2004 | Amirthalingam | 700/128 |
| 2004/0261965 | A1* | 12/2004 | Burma | 162/198 |
| 2006/0079986 | A1* | 4/2006 | Laitinen-Vellonen | 700/128 |
| 2006/0111808 | A1* | 5/2006 | Burma | 700/129 |
| 2006/0118259 | A1* | 6/2006 | Heikkinen et al. | 162/198 |
| 2007/0151690 | A1* | 7/2007 | MacHattie et al. | 162/198 |
| 2007/0158044 | A1* | 7/2007 | Jaschinski et al. | 162/198 |
| 2007/0169906 | A1* | 7/2007 | Munch et al. | 162/198 |
| 2007/0239310 | A1* | 10/2007 | Fan | 700/129 |

FOREIGN PATENT DOCUMENTS

| | | | | |
|---|---|---|---|---|
| JP | 63288291 | A | * | 11/1988 |
| WO | WO 9531602 | A1 | * | 11/1995 |
| WO | WO 9964963 | A1 | * | 12/1999 |
| WO | WO 0052265 | A1 | * | 9/2000 |
| WO | WO 0052266 | A1 | * | 9/2000 |

* cited by examiner

METHOD FOR PRODUCING OR TREATING A FIBROUS WEB

BACKGROUND OF THE INVENTION

1. Field of the Invention

This invention relates to a method for producing or treating a fibrous web, in particular a paper web or paperboard web, with which at least one property of the fibrous web, in particular a CD (cross direction) profile, such as the moisture CD profile, is established such that a preselected quality range is adhered to or a predefined quality value is undershot by no more than a predefined deviation.

In addition this invention relates to an apparatus for producing or treating a fibrous web, in particular a paper web or paperboard web, having a way which is constructed such that a property of the fibrous web, in particular a CD profile such as the moisture CD profile, is established therewith such that a preselected quality range is adhered to or a predefined quality value is undershot by no more than a predefined deviation.

2. Description of the Related Art

On paper machines there are CD profile actuating apparatuses, in particular for the moisture content of the paper web, whose power consumption lies in the megawatt range. Considerable savings in power can be made therefore by improving the CD profile actuating apparatuses.

A known way to save power is to minimize the mean load of the actuating elements. A certain actuator profile setting, which is calculated using a control algorithm, is required to improve the moisture CD profile. In most CD profile control apparatuses the mean actuator setting is a preselected value. In some apparatuses the actuator setting is slowly and continuously changed with the aim of minimizing the mean value without impairing the CD profile control in its function. The minimum is usually reached when the CD actuator with the smallest actuating value reaches the zero limit or a preselected absolute minimum value. A further decrease of the mean value of all actuators would change the actuating profile shape and impair the paper quality.

What is needed in the art is to enable a further saving of power.

SUMMARY OF THE INVENTION

The present invention provides a method of the type initially referred to in that the power consumption of the method, in particular the heat energy input, is reduced by establishing at least one property such that the lowest permissible value of the quality range or the maximum permissible deviation is reached at least approximately on a straight line.

With an apparatus of the type initially referred to, a way is constructed such that the power consumption of the method, in particular the heat energy input, is reduced therewith by establishing at least one property such that the lowest permissible value of the quality range or the maximum permissible deviation is reached at least approximately on a straight line.

The method of the present invention is thus controlled such that the power consumption is as low as possible, wherein the controlling is performed such that the lowest limit of the permissible quality is just reached. In other words, the method is not controlled to achieve a mean value of the quality range to be adhered to but is consciously controlled to achieve the minimum value. This results in additional potential for saving power, in particular in those cases in which the usual quality control achieves better quality values, meaning smaller 2-sigma deviations, than is really necessary for production.

The moisture CD profile can be a property of the fibrous web to be controlled. When the moisture CD profile of the fibrous web is too good, then the mean value of the actuators is lowered further to the point just where the setpoint quality deviation is not exceeded. An additional power saving is possible as the result.

Another measure when the moisture CD profile is too good is to soften the zonal influence on at least a part of the CD actuators, meaning the actuators arranged side by side in the CD direction of the fibrous web. The control system thus performs only softer CD profile corrections. Peaks in the actuating profile are reduced. If one of these peaks is responsible for the minimum actuator position, potential for a further lowering of the mean actuator set value can be tapped and the power consumption accordingly reduced further.

It is possible in particular for only the zonal influence on the CD actuators in the vicinity of the actuator with the minimum set value to be softened. An intensive lowering of the power consumption can thus be achieved without changing the zonal influence of the other CD actuators.

Similarly it is possible in particular for two or more properties, in particular CD profiles, of the fibrous web to be taken into account for the power reduction. By taking account of two or more properties it is possible to exploit even more potential for the power reduction.

For example it is possible to take account of not only the moisture CD profile but also the coating weight CD profile, in particular on a coater. When the coating weight CD profile is too good, then a part of the quality can be sacrificed in this case too in favor of the moisture CD profile and hence in favor of power optimization. The coating weight CD profile control establishes a compromise of moisture quality and coating quality such that the coating weight CD profile remains in a defined quality range—the setpoint quality of the coating weight—and the moisture deviation in particular near the minimum actuating elements is optimized.

Alternatively or in addition to this, it is possible to take account of not only the moisture CD profile but also the gsm (grams per square meter) substance (herein, the gsm substance is the grams per square meter of the paper web). It is known that the gsm substance of a paper web has an influence on the moisture distribution. Hence it is similarly possible to sacrifice the gsm substance quality in favor of an optimization of the moisture profile in order thereby to lower further the power input during the moisture profile correction.

The properties of the paper web can be established by way of heating actuators. It is also possible however to influence spray nozzles as actuators in particular when establishing the moisture.

Another aspect of the present invention relates to the controlling of a coating unit, which is intended to apply a certain quantity of coating per square meter. Using a corresponding control system, it is possible in this case too for the power consumption resulting from the necessary drying of the mean coating color application per zone to be reduced in that the permissible minimum quality of the coating application is selectively established by the control.

An apparatus according to the present invention includes a way for performing the previously described process steps.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplification is not to be construed as limiting the scope of the invention in any manner.

DETAILED DESCRIPTION OF THE INVENTION

Figure 1:
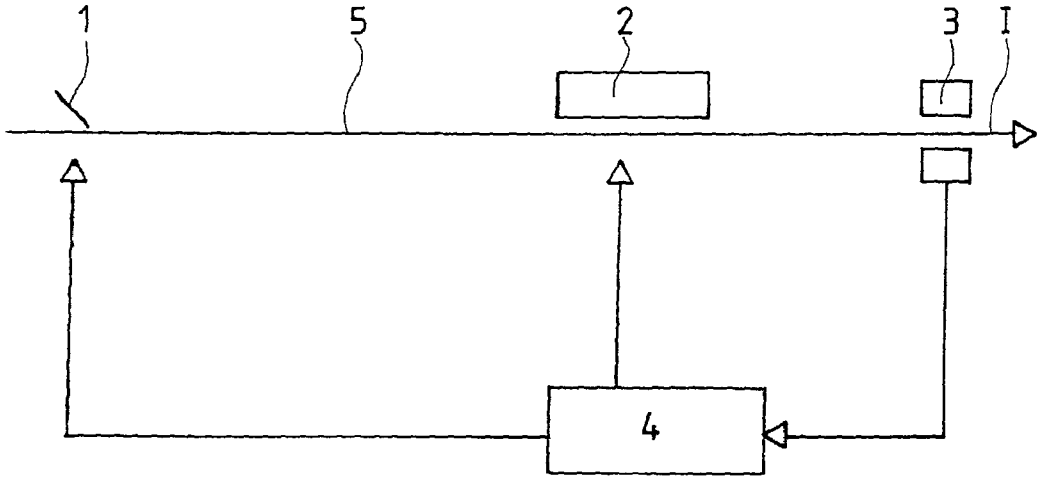
FIG. 1 shows the arrangement of components of an apparatus according to the present invention.

Referring now to the drawings, and more particularly to FIG. 1, there is shown an apparatus including a coating applicator 1, moisture actuating elements such as infrared radiant heaters 2, a quality measuring system 3 and a controller 4. The coating applicator 1, the moisture actuating elements 2 and the quality measurement system 3 are suitably arranged in the vicinity of the fibrous web 5, wherein the quality measuring system 3 is arranged after the coating applicator 1 and the moisture actuating elements 2 in the web running direction I.

The controller 4 is used to control the actuators of the coating applicator 1 and the moisture actuating elements 2. It is constructed such that the power consumed is minimal in that a minimum permissible quality value for the moisture CD profile and/or the coating application is consciously established.

Figure 2:
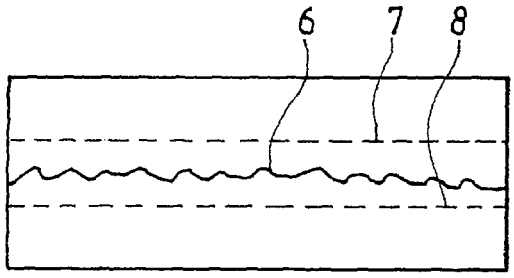
FIG. 2 shows the moisture CD profile of a fibrous web.

FIG. 2 shows the moisture CD profile 6 of a fibrous web, for example a paper web. The numerals 7 and 8 are used to designate the upper and lower limit of the permissible tolerance range for the moisture CD profile.

Figure 3:
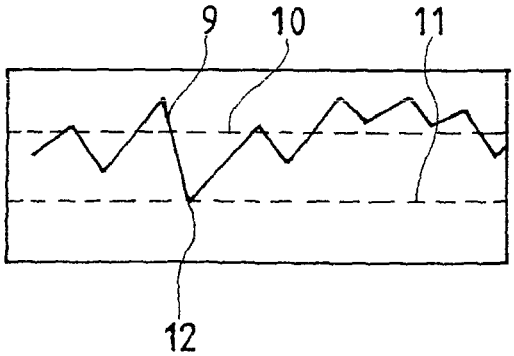
FIG. 3 shows the moisture actuating profile of the fibrous web.

FIG. 3 shows a related actuator setting 9 of the moisture actuating profile. The numeral 10 is used to designate the mean setting of the actuators and 11 the permissible absolute minimum value for the actuator setting. The actuator with the numeral 12 is thus already at the lower limit. A further lowering of the mean value 10 of the actuator setting would influence the shape of the actuating profile and hence the quality profile.

When it is found that the moisture CD profile is too good, the mean value of the actuators is lowered further, namely to the point just where the setpoint quality deviation is not exceeded. Or the zonal influence on the CD actuators is softened such that peaks in the actuating profile are reduced. This is done possibly only in the region of the actuator with the minimum set value. Finally, other properties of the fibrous web such as the coating weight CD profile or the gsm substance or the coating application of a coating unit can also be taken into account. The method can be applied in this case to heating as well as non-heating actuators such as spray nozzles. With these measures it is possible to achieve lower production costs in that the quality produced is established by the inventive control apparatus at a level that is only as good as the minimum required.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Coating applicator
2 Moisture actuating element
3 Quality measuring system
4 Controller
5 Fibrous web
6 Moisture CD profile
7 Upper limit of the tolerance range for the moisture CD profile
8 Lower limit of the tolerance range for the moisture CD profile
9 Moisture actuating profile
10 Mean value of the actuator setting
11 Absolute minimum value for the actuator setting
12 Actuator at the limit
I Web running direction

What is claimed is:

1. A method for one of producing and treating a fibrous web, comprising the steps of: establishing at least one property of the fibrous web such that one of a preselected quality range is adhered to and a predefined quality value is undershot by no more than a predefined deviation, said at least one property of the fibrous web including a cross direction profile, said step of establishing further including reducing a power consumption by establishing said at least one property such that one of (a) a lowest permissible value of a quality range is reached and maintained and (b) a maximum permissible deviation is reached and maintained at least approximately on a straight line such that said cross direction profile, which has been detected, is adjusted on a zonal basis to an at least approximately constant value across substantially all of said cross direction profile, substantially along one of said lowest permissible value and said maximum permissible deviation, said power consumption including a heat energy input.

2. The method according to claim 1, wherein said cross direction profile includes a moisture cross direction profile of the fibrous web.

3. The method according to claim 2, further comprising lowering a mean value of an actuator setting for establishing said moisture cross direction profile in order to reduce said power consumption.

4. The method according to claim 2, wherein only said zonal influence on said plurality of cross direction actuators in a vicinity of an actuator with a minimum set value is softened.

5. The method according to claim 2, further comprising softening a zonal influence on at least a part of a plurality of cross direction actuators in order to reduce said power consumption.

6. The method according to claim 1, wherein said at least one property includes at least two properties of the fibrous web which are taken into account for a power reduction, said at least two properties including cross direction profiles.

7. The method according to claim 6, wherein said at least two properties include (a) said moisture cross direction profile and (b) a coating weight cross direction profile of the fibrous web when the fibrous web has been coated.

8. The method according to claim 6, wherein said coating weight cross direction profile is associated with a coater.

9. The method according to claim 6, wherein said at least two properties include said moisture cross direction profile and grams per square meter of the fibrous web.

10. The method according to claim 6, wherein said at least two properties includes one of two and three properties, a compromise being established regarding a quality of said one of two and three properties.

11. The method according to claim 1, wherein said at least one property is established using a plurality of heating actuators.

12. The method according to claim 1, wherein said at least one property is established using a plurality of actuators with spray nozzles.

13. The method according to claim 1, wherein said at least one property is established using at least one coating unit.

* * * * *